US005967331A

United States Patent [19]

Katyshev et al.

[11] Patent Number: 5,967,331

[45] Date of Patent: Oct. 19, 1999

[54] METHOD AND APPARATUS FOR FREE FALL ELECTROSTATIC SEPARATION USING TRIBOELECTRIC AND CORONA CHARGING

[76] Inventors: Anatoly L. Katyshev, 907-111 Ridelle Ave., Toronto; Oleg B. Kukar, 43 Salt Creek Ave., Richmond Hill; Igor Yu. Sokolov, 14 Park Lane, Etobicoke, all of Canada

[21] Appl. No.: 08/958,792

[22] Filed: Oct. 27, 1997

[51] Int. Cl.[6] ..... B03C 7/00

[52] U.S. Cl. ..... 209/127.4; 209/128; 209/129; 209/130; 209/127.1

[58] Field of Search ..... 209/127.4, 128, 209/129, 130, 127.1

[56] References Cited

U.S. PATENT DOCUMENTS

| | | | |
|---|---|---|---|
| 2,174,681 | 10/1939 | Bartlett . | |
| 2,258,767 | 10/1941 | Johnson | 209/127.1 |
| 2,314,939 | 3/1943 | Hewitt et al. | 209/127.1 |
| 2,479,615 | 8/1949 | Guizzetti | 209/127.4 |
| 2,782,923 | 2/1957 | Cook et al. | 209/127.4 |
| 3,059,772 | 10/1962 | Le Baron . | |
| 3,292,786 | 12/1966 | Korzekwa | 209/129 |
| 3,625,360 | 12/1971 | Schickel . | |
| 3,926,916 | 12/1975 | Mastrangelo | 252/63.5 |
| 3,970,546 | 7/1976 | Webb et al. . | |
| 4,092,241 | 5/1978 | Mackenzie et al. . | |
| 4,172,028 | 10/1979 | Dunn . | |
| 4,297,207 | 10/1981 | Singewald et al. . | |
| 4,326,951 | 4/1982 | Broz . | |
| 4,362,276 | 12/1982 | Morey . | |
| 4,557,827 | 12/1985 | Fricke et al. . | |
| 4,743,362 | 5/1988 | Pfoh et al. | 209/127.1 |
| 4,767,506 | 8/1988 | Fricke . | |
| 4,882,043 | 11/1989 | Jung . | |
| 5,079,121 | 1/1992 | Facci et al. | 430/62 |
| 5,118,407 | 6/1992 | Beck et al. . | |
| 5,289,922 | 3/1994 | Inculet et al. . | |
| 5,358,119 | 10/1994 | Stahl et al. . | |
| 5,366,091 | 11/1994 | Stahl et al. . | |
| 5,542,543 | 8/1996 | Yasukuni . | |
| 5,637,136 | 6/1997 | Horinka et al. | 106/14.5 |

FOREIGN PATENT DOCUMENTS

| | | | |
|---|---|---|---|
| 1776440 | 11/1992 | U.S.S.R. | 209/127.4 |

*Primary Examiner*—William E. Terrell
*Assistant Examiner*—Joe Dillon, Jr.
*Attorney, Agent, or Firm*—Barrigar & Moss

[57] ABSTRACT

A free-fall separator apparatus for mixed particles. The apparatus includes a screw feeder for triboelectrically charging the particles, a feed hopper for releasing the tribocharged particles in a laminar flow path between a first electrode structure and a second electrode structure. The first electrode structure provides corona charging for the falling particles, and a substantially uniform electrostatic separation field is provided between the electrode structures for separating the falling particles. The electrode structures may each include a plurality of vertically extending string electrodes. Also provided is a method for sorting mixed particles which includes steps of charging the particles through contact electrification, releasing the mixed particles to fall freely in a substantially laminar stream, charging the particles electrically through corona discharge, and separating the particles through an electrostatic separation field.

3 Claims, 1 Drawing Sheet

METHOD AND APPARATUS FOR FREE FALL ELECTROSTATIC SEPARATION USING TRIBOELECTRIC AND CORONA CHARGING

BACKGROUND OF THE INVENTION

This invention relates to the electrostatic separation of materials, and particularly to a method and apparatus for the free-fall electrostatic separation of materials.

Two common forms of electrostatic separators are triboelectric separators and corona separators. In corona separators, the particles to be separated are charged by subjecting them to the corona discharge of a high voltage corona electrode. Typically, this is accomplished by passing the particles between a corona electrode (having either a high negative charge or a high positive charge) and a grounded electrode. Current leakage from the corona electrode ionizes the molecules of air adjacent the corona electrode, with the result that particles passing between the corona electrode and the grounded electrode are subjected to ionic bombardment. Many of the ions discharge against the particles, thus causing the particles to gain a positive surface charge if the corona discharge electrode is a positive electrode, or a negative surface charge if the corona discharge electrode is a negative electrode. As it is easier to cause ionization in the vicinity of a curved electrode, corona electrodes are generally considerably curved electrodes, such as small diameter tube electrodes.

A corona separator works on the principle that the surface charge applied to different particles types discharges at a rate in accordance with the surface conductivity of the particles. The surface charge applied to highly conductive particles tends to discharge rapidly, and particles having high dielectric values will discharge at a much slower rate.

In order to effect separation in a free-fall corona separator, the particles are dropped through an electrostatic field in which the differently discharged particles are subjected to different degrees of deflection as a result of the applied coulomb forces associated with their charges.

As corona separation depends primarily on differences in the conductivity of the particles to be separated, it is primarily used to separate conductive materials from dielectric materials, but is generally not effective for separating dielectric materials from each other. An example of a free fall corona separator is disclosed in U.S. Pat. No. 3,625,360 issued to A. Schickel, which includes a corona charging electrode located above an electrostatic separation field provided by a plate capacitor.

In a triboelectric separator, particles are charged through contact electrification which can be carried out through rubbing among the particles or through contact between the particles in an operating medium. Corresponding to their specific electrical properties, particles having different work functions assume different charges when brought into contact. If two materials are brought into physical contact, it is believed that the material having the smaller work function transfers electrons to the material having the larger work function, with the result that the material having the smaller work function will acquire a positive charge and the material having the larger work function will acquire a negative charge. Thus, a pair of different particulate materials can be tribocharged with opposite signs, and the particles can then be separated by passing them between differentially charged electrodes.

The dielectric strength of a material increases as its work function increases, such that the greater the dielectric strength of a material, the greater its work function is. Triboelectric separation is generally suitable for separating different dielectric materials from each other.

As the triboelectric charging process generally creates relatively weak charges, the materials to be separated often must be pretreated in the form of heating or surface active reagent treatment in order to allow the particles to gain a sufficient charge. Pretreatment is not always practical or cost effective. An example of a triboelectric separator is disclosed in U.S. Pat. No. 5,118,407 issued to M. H. Beck et al.

Although there are a number of triboelectric separators and a number of corona separator designs, the existing electrostatic separators have not made use of both triboelectric charging and corona charging to effect separation of dielectric materials from dielectric materials or of dielectric materials from conductive materials. It is thus desirable to provide a method of electrostatic separation and a corresponding separator apparatus for separating different dielectric materials from each other, or dielectric materials from conductive materials, which employs both triboelectric and corona charging. It is also desirable to provide an electrode structure which can simultaneously provide a corona charging effect and a uniform electrostatic separation field.

SUMMARY OF THE INVENTION

According to one aspect of the invention there is provided a separator apparatus for sorting mixed particles. The separator apparatus comprises a tribocharging means for charging the particles through contact electrification, a feed hopper for receiving the particles from the tribocharging means and releasing the particles to fall freely in a substantially laminar flow path, a first electrode structure located on one side of the laminar flow path, and a second electrode structure located on an opposite side of the laminar flow path. The first electrode structure and the second electrode structure are arranged such that upon application of a first predetermined voltage potential to the first electrode structure and a second predetermined voltage potential to the second electrode structure, corona discharge suitable for corona charging of the falling particles occurs in the vicinity of the first electrode structure and a substantially uniform electrostatic separation field is provided between the first electrode structure and the second electrode structure through said flow path.

Preferably, the first electrode structure includes a plurality of vertically extending string electrodes, each of which can generate a corona discharge upon application of the first predetermined voltage to the first electrode structure. The second electrode structure may also include a plurality of vertically extending string electrodes and the first electrode structure and the second electrode structure each include the same number of equally spaced string electrodes, and the electrode structures arranged such that the string electrodes of the first electrode structure are located in a vertical plane parallel to the string electrodes of the second electrode structure.

Preferably, the feed hopper includes dielectrically coated opposing sides which converge to form an elongate slot-like opening in a lower end of the feed hopper, the longitudinal axis of the opening being parallel to the vertical planes of the electrode structures. Preferably, the second predetermined voltage potential is a ground potential.

Preferably, the tribocharging means includes a screw feeder having a feed opening at one end for receiving the mixed particles and a discharge opening at an opposite end for discharging the mixed particles into said feed hopper.

The surface of the screw feeder which contacts the mixed particles is conveniently a dielectric surface.

According to another aspect of the invention, there is provided a free-fall separator apparatus for sorting mixed particles, comprising a first electrode structure having a plurality of vertically extending spaced apart elongate electrodes, and a second electrode structure spaced apart from the first electrode structure. The first electrode structure and the second electrode structure are arranged such that upon application of a first predetermined voltage potential to the first electrode structure and application of a second predetermined voltage potential to the second electrode structure, corona discharge suitable for charging freely falling particles occurs in the vicinity of the first electrode structure and a substantially uniform electrostatic separation field for the freely falling particles is provided between the first electrode structure and the second electrode structure.

Preferably, the elongate electrodes are substantially similar to each other and have a circular cross-section with a diameter of between 2 mm and 5 mm. The second electrode structure preferably includes a plurality of vertically extending elongate electrodes which are substantially similar to the elongate electrodes of the first electrode structure. Conveniently, the second electrode structure is substantially identical to the first electrode structure, and the elongate electrodes of the first electrode structure are arranged in a vertical plane parallel to the elongate electrodes of the second electrode structure. Preferably, the distance between the first electrode structure and the second electrode structure, the number of elongate electrodes comprising the electrodes structures, and the spacing between the elongate electrodes of each electrode structure can be varied.

Preferably, the free-fall separator apparatus further includes a screw feeder for triboelectrically charging the mixed particles before the particles are released to fall freely between the electrode structures. The screw feeder has a feed opening at one end for receiving the mixed particles and a discharge opening at an opposite end for discharging the mixed particles, and the surface of the screw feeder which contacts the mixed particles is a dielectric surface. A feed hopper may be provided for receiving the particles from the screw feeder and releasing the particles to fall freely in an initially substantially laminar flow path between the electrode structures.

According to a further aspect of the invention there is provided a method for sorting mixed particles comprising the steps of charging the mixed particles electrically through contact electrification, releasing the mixed particles to fall freely in a substantially laminar stream, charging the freely falling mixed particles electrically by corona discharge and separating the mixed particles through an electrostatic field within the path of the freely falling particles into groups of sorted particles.

BRIEF DESCRIPTION OF THE DRAWINGS

By way of further explanation of the invention, an exemplary embodiment of the invention will now be described with reference to the accompanying drawing, in which.

DETAILED DESCRIPTION OF THE INVENTION

Figure 1:
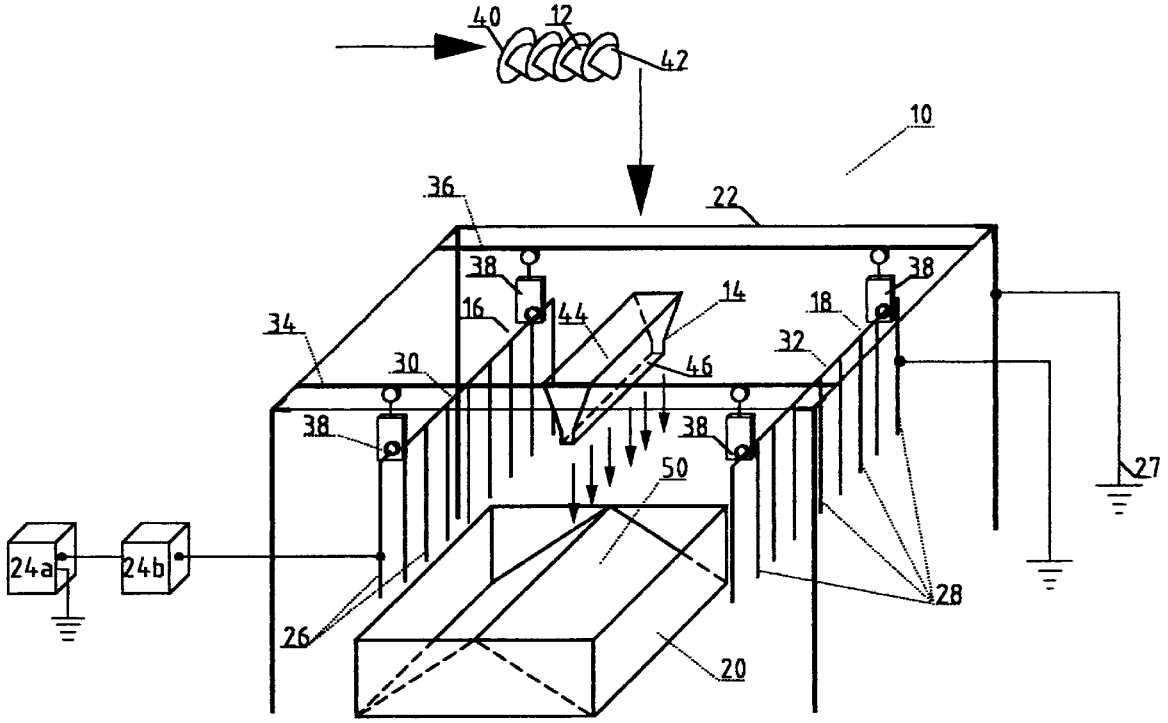
FIG. 1 illustrates a perspective view of a separation apparatus in accordance with the present invention.

With reference to FIG. 1, a separator apparatus, indicated generally by 10, of the present invention comprises a screw feeder 12, a feed hopper 14, two opposing electrode structures 16 and 18, and a collection bin 20. The electrodes 16 and 18 are preferably housed within and supported by a frame 22, which may be grounded. The electrode 16 is connected to a high voltage supply 24*a* and in one preferred embodiment the electrode 18 is connected to a ground potential 27. The electrodes 16 and 18 are configured so that corona discharge can be started and maintained by the high voltage electrode 16 upon application of a predetermined voltage potential to the high voltage electrode 16, while at the same time permitting a relatively uniform electrostatic separation field to be defined between the high voltage electrode 16 and the grounded electrode 18.

In order to provide this dual functionality, the electrode structures 16 and 18 are each made up of a plurality of small diameter elongate string electrodes, indicated generally by 26 and 28, respectively. The elongate string electrodes 26 of the high voltage electrode 16 are each suspended vertically in a line from a horizontal conductive support member 30 and the string electrodes 28 of the grounded electrode 18 are similarly suspended from a further horizontal conductive support member 32.

The support members 30, 32 are preferably suspended by insulated hangers 38 from two horizontal parallel tracks 34, 36 which extend across an upper portion of the frame 22. The insulated hangers 38 each preferably include a roller which co-operates with its corresponding track 34, 36 such that the electrodes 16 and 18 can be moved towards and away from each other as required. The string electrodes 26 and 28 are preferably connected to their respective supporting members 30 and 32 in such a manner that they can be removed and replaced, thus permitting the number of string electrodes and the spacing therebetween to be varied if required.

As will be understood by those skilled in the art, the smaller the diameter of the string electrodes, the lower the voltage required to start corona discharge will be, and also the lower the voltage required to reach the air breakpoint will be (air breakpoint being the potential at which the air between the electrode 16 and 18 ionizes to the point that it effectively becomes a short circuit). In order to maintain both corona discharge and a uniform separation field, the voltage applied to the high voltage electrode 16 must be above the predetermined value at which corona discharge by the string electrodes 26 will occur, but below the voltage at which the air breakpoint is reached. Thus, the diameter of the string electrodes 26, 28, and the number and spacing of the string electrodes are selected so that corona discharge can be achieved in the vicinity of the high voltage electrode 16 at a voltage potential that can also provide a separation field of sufficient intensity between the electrode structures 16 and 18 without reaching the air break point. Although the required intensity of the separation field will depend on the materials to be separated, the string electrodes preferably have a diameter in the range of 2 mm to 5 mm, although in some applications string electrodes with a diameter as small as 1 mm or as large as 7 mm may be satisfactory.

The voltage supply 24*a* is used to supply a voltage potential to the high voltage electrode 16 which is sufficient to achieve corona discharge without exceeding the air breakpoint. In order to provide the highest intensity separation field possible for a given set of string electrodes, the magnitude of the potential applied to the electrode 16 is preferably maintained as close as practically possible to the voltage at which air breakpoint would occur. A variable voltage controller 24*b* is preferably connected between the voltage supply 24*a* and the electrode 16. The controller 24*b* may be a manually controlled adjustable voltage controller, or it may be a processor controlled device which is pre-programmed in a known manner to provide a desired potential to the electrode 16. The controller 24*b* may include a current monitor such that when the leakage current between the electrodes 16 and 18 exceeds an upper threshold the controller 24*b* will automatically reduce the potential applied to the high voltage electrode 16 (so as to avoid reaching the air breakpoint), and when the leakage current drops below a lower threshold, the controller 24*b* will increase the potential applied to the electrode 16, so as to maintain the strongest separation field intensity possible.

The screw feeder 12 is provided to triboelectrically charge the particulate materials to be separated. The screw feeder 12, which operates similar to a conventional screw feeder for granular materials, is preferably either made from a dielectric material or coated with a dielectric material. The screw feeder 12 has a feed opening 40 at one end for receiving the particulate materials to be separated from a suitable source such as a feed bin (not shown). A discharge opening 42 is provided at the opposite end of the screw feeder 12 for discharging the particulate material into the feed hopper 14. A motor (not shown) or other suitable means is used to rotate the screw feeder 42 so that particulate material fed into the feed opening 40 will progress along the length of feeder 12 and exit from the discharge opening 42. One suitable dielectric material which may be used for the screw feeder 12 is PVC.

The feed hopper 14 includes opposed dielectric guiding surfaces 44 for discharging particulate materials received from the screw feeder 12 into the electrostatic field defined by the electrodes 16 and 18. A narrow slot-like discharge opening 46 is provided along the bottom of the feed hopper 14. The dielectric guiding surfaces 44 converge in the vicinity of the opening 46 so that the particulate material falls from the hopper 14 in a substantially laminar stream with no (or negligible) initial horizontal velocity. The feed hopper 14 is preferably secured to the frame 22 such that it can be moved towards and away from high voltage electrode 16 as required. The hopper 14 will normally be positioned closer to the high voltage electrode 16 than the grounded electrode 18 so that the particulate material leaving through the opening 46 will fall through the corona discharge of the electrode 16.

The collection bin 20 is provided at the bottom of the separator field to collect the separated particles. The bin 20 has an inverted V-shaped bottom 50 so that materials which are deflected different degrees as they fall through the separation field will remain separated in the bin 20.

For safety reasons, the frame 22 may be surrounded with fibreglass panels with a suitable opening or door provided in one of the panels.

With reference to FIG. 1, a method of separating particulate materials in accordance with the present invention and the operation of the separator apparatus 10 will hereinafter be explained. A mixture of two different types of dielectric particles, or a mixture of dielectric particles and conductive particles, is fed into the feed opening 40 of the screw feeder 12 wherein the rotation of the screw feeder 12 causes the particles to progress toward its discharge end 42. As the materials pass through the screw feeder, a triboelectric charging occurs as the particles repeatedly contact each other such that the particles having a higher work function acquire a negative charge and the particles having a lower work function acquire a positive charge. As the screw feeder 12 is made from dielectric material (or is dielectrically coated) any charge leakage from the particles contacting the screw feeder is minimized. The magnitude of the triboelectrically induced charge increases in the particles as they progress towards the discharge end 42 of the screw feeder. Upon reaching the end 42, the particles are discharged into the hopper 14, which itself is made from a dielectric material (or is dielectrically coated) so as to minimize any discharge from the tribocharged particles. The particles fall through the slot like opening 46 of the hopper 14 in a substantially laminar stream with negligible initial horizontal velocity. Thus, the particles leave the hopper 14 in a substantially vertical plane that is parallel to the vertical planes of the electrodes 16 and 18.

As the particles leave the hopper 14, they fall between the electrodes 16 and 18. In one preferred embodiment, the voltage supply 24*a* and controller 26*b* are used to apply a negative potential to the high voltage electrode 16 which is sufficient to start corona discharge at each of the string electrodes 26, but low enough so that the air break point between the electrodes 16 and 18 is not reached. Preferably, the voltage potential is maintained at just below the air break point, such that the maximum possible separation field intensity can be maintained between the high voltage electrode 16 and the grounded electrode 18.

Upon leaving the discharge opening 46 of the hopper 14, the particles are subjected to ionic bombardment as a result of the corona discharge occurring in the vicinity of the high voltage electrode 16. Particles which acquired a negative charge during the tribocharging process will be immediately deflected away from the negative high voltage electrode 16 towards the grounded electrode 18. Additionally, the corona discharge of the electrode 16 will cause these negatively charged particles to gain an even greater negative charge, further increasing the force with which such particles are deflected from the high voltage electrode 16.

Particles which gained and maintained a positive charge during tribocharging will, upon leaving the hopper 14, initially be attracted towards the negative high voltage electrode 16. These positive charged particles will be subjected to the corona charging effect of the electrode 16 and may assume a negative charge. However, as particles which gained a positive charge during tribocharging will generally have a low work function and a low dielectric strength (relative to the particles which gained a negative charge during tribocharging), such particles will generally lose any corona induced negative charge quite quickly. Thus, the degree to which particles that initially have a positive charge after tribocharging are deflected as they free-fall between the electrodes 16 and 18 will generally be quite small relative to the degree of deflection of the particles that have a negative charge after tribocharging. Once the particles have fallen through the separation field they are caught by the collection bin 20, wherein differently deflected particles end up on opposite sides of the inverted V-shaped base 50.

Particles which initially have a neutral charge upon leaving the hopper 14 will not be subjected to any initial deflection away from the electrode 16. They may acquire a negative charge as a result of corona charging, however as particles having a neutral charge after the tribocharging process will generally have a higher conductivity, such particles will quickly lose any acquired surface charge and thus will be deflected from the electrode 16 a distance less than the dielectric materials they were originally mixed with.

As the electrodes 16 and 18 providing the uniform electrostatic separation field are string electrodes, collisions between the electrodes and the particles being separated are minimized, thus reducing the occurrence of material build-up on the electrode structures.

The apparatus 10 and the method of the present invention rely on differences in both surface conductivity and work function of the different materials in order to effect separation. It is believed that by using corona charging in addition to triboelectric charging, a more efficient separation rate for separating different types of dielectric materials and for separating dielectric materials from conductive materials can be obtained than by using triboelectric charging alone, thus eliminating or reducing the extent of pretreatment required before the particulate materials are tribocharged.

The above process can be repeated more than once to provide a multi-stage separation process. Furthermore, a plurality of the separator apparatus 10 can be serially combined together to form a multi-stage separator apparatus.

Although as described above the particles to be separated were subjected to tribocharging prior to being dropped between the electrodes 16 and 18, it will be appreciated that in some situations where dielectric particles are to be separated from conductive particles, the separator 10 may operate satisfactorily without first tribocharging the particles. In such a situations, the particles can be fed directly to the feed hopper 14 without passing through the feed screw 12.

In certain situations, it may be desirable to apply a positive voltage to the high voltage electrode 16 (rather than a negative voltage) depending on the material to be separated. Additionally, it may also be desirable in some circumstances to provide the electrode 18 with a potential other than ground potential. For example, the electrode 18 could be connected to a voltage source having the opposite polarity of the high voltage electrode 16. It will be understood that the string electrodes could be supported in a variety ways other than by the horizontal support members disclosed above. Furthermore, the electrode 18 need not be comprised of a plurality of string electrodes, but rather could be a plate electrode or other suitable electrode, as long as a relatively uniform separation field can be maintained between the electrode 16 and the electrode 18.

A test apparatus was constructed in accordance with the present invention. In the test apparatus, the electrodes 16 and 18 each included nine (9) string electrodes having a diameter of 5 mm. A 6.25 cm horizontal spacing was provided between each of the individual string electrodes. The distance between the high voltage electrode 16 and the grounded electrode 18 was kept between 10 cm to 12 cm and the string electrodes were each 80 CM long. It was determined that corona discharge started when the potential applied to the high voltage electrode 16 had a magnitude of about 45 KV (and the electrode 18 was connected to ground), and it was further determined that the air break point was reached when a potential of about 70 KV was applied to the electrode 16. Thus, the preferred operating voltage magnitude for the test apparatus (for both safety and efficiency reasons) was selected to be approximately 60 KV.

It was found that a better separation rate for separating different dielectric materials could be achieved with the test apparatus than could be achieved by tribocharging the particles with a screw feeder and then dropping the particles through a conventional electrostatic field without corona charging. Using the test apparatus, a number of experiments were carried out as follows:

EXAMPLE 1

Table salt was purificated from unsolvables and other admixtures using multistage electrostatic separation with the following results:

EXAMPLE 1

| | Unsolvables | $SO_4$ -- | Mg++ | Ca++ |
|---|---|---|---|---|
| Feeding | 0.056% | 0.27% | 0.04% | 0.14% |
| Purificated | 0.018% | 0.140% | 0.031% | 0.065% |

Recovery was 62%.

EXAMPLE 2

Sylvinit ore was beneficiated using two stage electrostatic separation with the following results:

| | Feeding | Stage I | Stage II |
|---|---|---|---|
| KCI % | 27 | 62 | 85 |
| Recovery % | 100 | 81 | 68 |

EXAMPLE 3

Phosphate fertilizers were beneficated using single-stage electrostatic separation from 21% $P_2O_5$ to 26% $P_2O_5$ with a theoretical maximum of 32% $P_2O_5$. Recovery was 70%.

EXAMPLE 4

Experiments devoted to separation of tomato seeds according to their germination were conducted using the electrostatic separation method. A 200 gram sample of 80% germination tomato seeds was fed into the apparatus. As a result of the separation process 20 grams of 40% germination seeds were removed from the sample. That means the germination of the rest of the sample (180 grams) was increased to 85% with a recovery of 90%.

As will be apparent to those skilled in the art in the light of the foregoing disclosure, various alterations and modifications are possible in the practice of this invention without departing from the spirit or scope thereof. Accordingly, the scope of the invention is to be construed in accordance with the substance defined by the following claims.

What is claimed is:

1. A free-fall separator apparatus for sorting mixed particles, comprising:

a first electrode structure having a plurality of vertically extending uniformly spaced apart elongate string electrodes;

a second electrode structure spaced apart from said first electrode structure, said first electrode structure and said second electrode structure being arranged such that upon application of a first predetermined voltage potential to said first electrode structure and application of a second predetermined voltage potential to said second electrode structure, corona discharge which is sufficient for corona charging of freely falling particles occurs in the vicinity of said first electrode structure and a substantially uniform electrostatic separation field for effecting electrostatic separation of said freely falling particles is provided between said first electrode structure and said second electrode structure, said elongate string electrodes each having a circular cross-section with a diameter of between 2 mm and 5 mm; and a support frame having overhead track means mounted thereto, at least one of said electrode structures being slidably mounted to said track means such that the distance between said first electrode structure and second electrode structure can be varied.

2. A free-fall separator apparatus for sorting mixed particles, comprising:

a first electrode structure having a plurality of vertically extending uniformly spaced apart elongate string electrodes;

a second electrode structure spaced apart from said first electrode structure, said first electrode structure and said second electrode structure being arranged such that upon application of a first predetermined voltage potential to said first electrode structure and application of a second predetermined voltage potential to said second electrode structure, corona discharge which is sufficient for corona charging of freely falling particles occurs in the vicinity of said first electrode structure and a substantially uniform electrostatic separation field for effecting electrostatic separation of said freely falling particles is provided between said first electrode structure and said second electrode structure; and a first voltage potential source operatively connected to said first electrode structure for providing said first predetermined voltage thereto and a second voltage potential source operatively connected to said second electrode structure for providing said second predetermined voltage potential to said second electrode structure, wherein said first voltage potential source is a programmable variable voltage source and includes current monitoring means and is programmed to operate such that when leakage current between said first and second electrode structures exceeds an upper threshold said variable voltage source will automatically reduce the potential applied to the first electrode structure, and when the leakage current drops below a lower predetermined threshold, the variable voltage source will automatically increase the potential applied to the first electrode structure, said upper threshold and lower threshold being selected to maintain the potential between said electrode structures at a magnitude just below air breakpoint between the two electrode structures.

3. A separator apparatus according to claim 2 wherein said first predetermined voltage potential and said second voltage potential are selected so that the potential difference between said first and second electrode structures is between 45 KV to 70 KV, and said first and second electrode structures are located between 10 to 12 cm apart from each other.

* * * * *